US005497840A

United States Patent [19]

Hudson

[11] Patent Number: 5,497,840

[45] Date of Patent: Mar. 12, 1996

[54] PROCESS FOR COMPLETING A WELL

[75] Inventor: Leo D. Hudson, Bakersfield, Calif.

[73] Assignee: Bestline Liner Systems, Bakersfield, Calif.

[21] Appl. No.: 340,109

[22] Filed: Nov. 15, 1994

[51] Int. Cl.[6] ..... C21B 43/00

[52] U.S. Cl. ..... 175/72; 166/278; 166/285

[58] Field of Search ..... 175/72; 166/285, 166/267, 278, 51, 55

[56] References Cited

U.S. PATENT DOCUMENTS

| | | | |
|---|---|---|---|
| 4,253,522 | 3/1981 | Setterberg | 166/278 |
| 4,365,671 | 12/1982 | Long | 166/318 |
| 4,401,158 | 8/1983 | Spencer et al. | 166/51 |
| 4,438,815 | 3/1984 | Elson et al. | 166/51 |
| 4,519,451 | 5/1985 | Gray et al. | 166/278 |
| 4,606,408 | 8/1986 | Zunkel et al. | 166/51 X |
| 4,628,993 | 12/1986 | Zunkel | 166/51 |
| 4,635,725 | 1/1987 | Burroughs | 166/278 |
| 4,726,419 | 2/1988 | Zunkel | 166/278 X |
| 4,750,571 | 6/1988 | Greeting | 175/314 |
| 4,796,706 | 1/1989 | Townsend et al. | 166/380 |
| 5,052,483 | 10/1991 | Hudson | 166/55 |
| 5,052,488 | 10/1991 | Fraser, III | 166/285 |
| 5,253,708 | 10/1993 | Alexander | 166/278 |
| 5,255,741 | 10/1993 | Alexander | 166/278 |
| 5,332,038 | 7/1994 | Tapp et al. | 166/278 |
| 5,343,949 | 9/1994 | Ross et al. | 166/278 |

*Primary Examiner*—Michael Powell Buiz
*Attorney, Agent, or Firm*—Lyon & Lyon

[57] ABSTRACT

Processes for completing a well with a well liner which can be accomplished with a single placement of the equipment in the well.

5 Claims, 4 Drawing Sheets

PROCESS FOR COMPLETING A WELL

BACKGROUND OF THE INVENTION

The field of the present invention is well drilling equipment and processes.

In drilling operations in water environments such as undersea oil drilling, well leakage can be a critical problem. This also may be true regarding leakage between zones even in more conventional drilling operations. To avoid any problem of this sort, well cement is frequently employed to insure against such events.

When drilling to a productive zone, a casing is employed to line the wall of the well. The casing typically does not extend through the productive zone. Rather, when needed, a liner is positioned to extend downwardly in the well from the casing. A mechanism for sealing the upper end of the liner to the bottom portion of the casing is illustrated in U.S. Pat. No. 5,052,483 for a sand control adapter, the disclosure of which is incorporated herein by reference. Even with the seal, the well may be cemented around the periphery of the liner.

The process of placing and cementing a liner for the completion of a well has typically required multiple trips down the well to drill the bore, place, cement, seal and clear the liner. The liner may be drilled in or separately positioned. When the liner is drilled in, a drilling bit is positioned on the lower end of the liner. Some means for applying torque through the liner to the drilling bit is then necessary.

Cementing a well involves the introduction of cement into the well and down through the positioned liner. Through use of a wiper plug backed by fluid, the volume of cement previously introduced to the well is forced down and out of the bottom of the liner where it flows upwardly around the annular space outwardly of the liner. In cementing a liner, crews have found it advantageous to either oscillate the liner axially or rotationally to enhance cement flow. Thus, during cementing, some means for again providing forced driving of the liner is considered advantageous. Sealing and hanging the liner within the casing is typically also performed.

The steps necessary for such well completion have typically required multiple trips into the well. A desire to limit the number of trips into the well has existed. Schemes for gravel packing wells and the like with a single placement of drilling tools have been used. Reference is made to U.S. Pat. Nos. 5,253,708 for PROCESS AND APPARATUS FOR PERFORMING GRAVEL-PACKED LINER COMPLETIONS IN UNCONSOLIDATED FORMATIONS and 5,255,741 for PROCESS AND APPARATUS FOR COMPLETING A WELL IN AN UNCONSOLIDATED FORMATION, the disclosures of which are incorporated herein by reference.

SUMMARY OF THE INVENTION

The present invention is directed to processes for completing a well with a well liner which can be accomplished with a single placement of the equipment in the well.

In an aspect of the present invention, a process for cementing a liner, hanging the liner, sealing the liner and releasing the liner is accomplished with a single tool assembly.

Accordingly, it is an object of the present invention to provide improved completion processes. Other and further objects and advantages will appear hereinafter.

DETAILED DESCRIPTION OF THE PREFERRED EMBODIMENT

Figure 1:
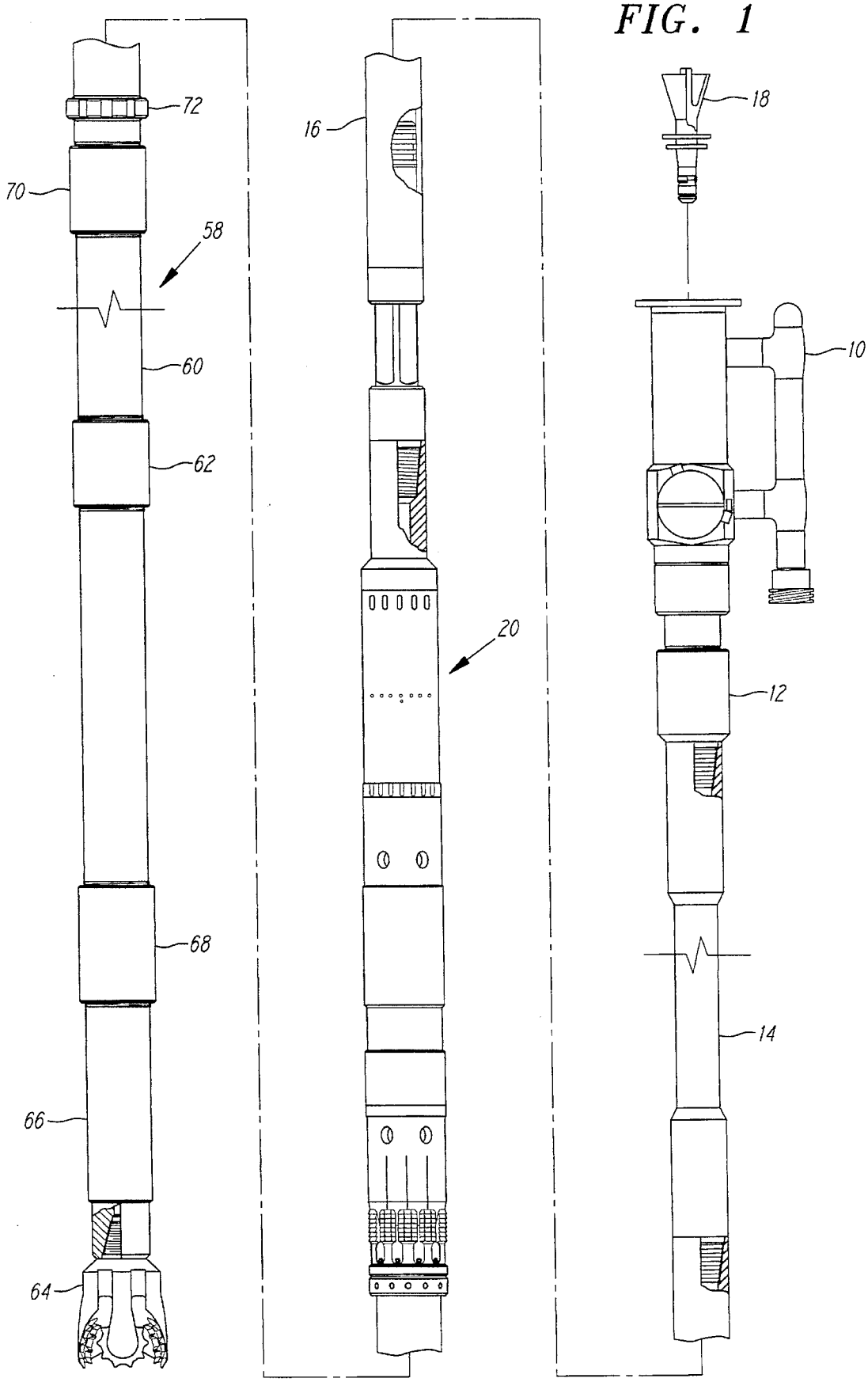
FIG. 1 is a string assembly employing the present invention.

Turning in detail to the drawings, FIG. 1 illustrates a full tool string assembly to generally illustrate the layout of the preferred embodiment. A conventional cementing head 10 is positioned atop a head-pin crossover 12, drill pipe 14 and a sealed bumper 16. A dart 18 is shown in position for entry into the tool string assembly. The drill pipe 14 is shown broken and would extend for thousands of feet when the assembly is positioned in the well. Drill pipe 14 and sealed bumper 16 are capable of transmitting both torque and axial load from the top of the well to the lower assembly.

Figure 2:
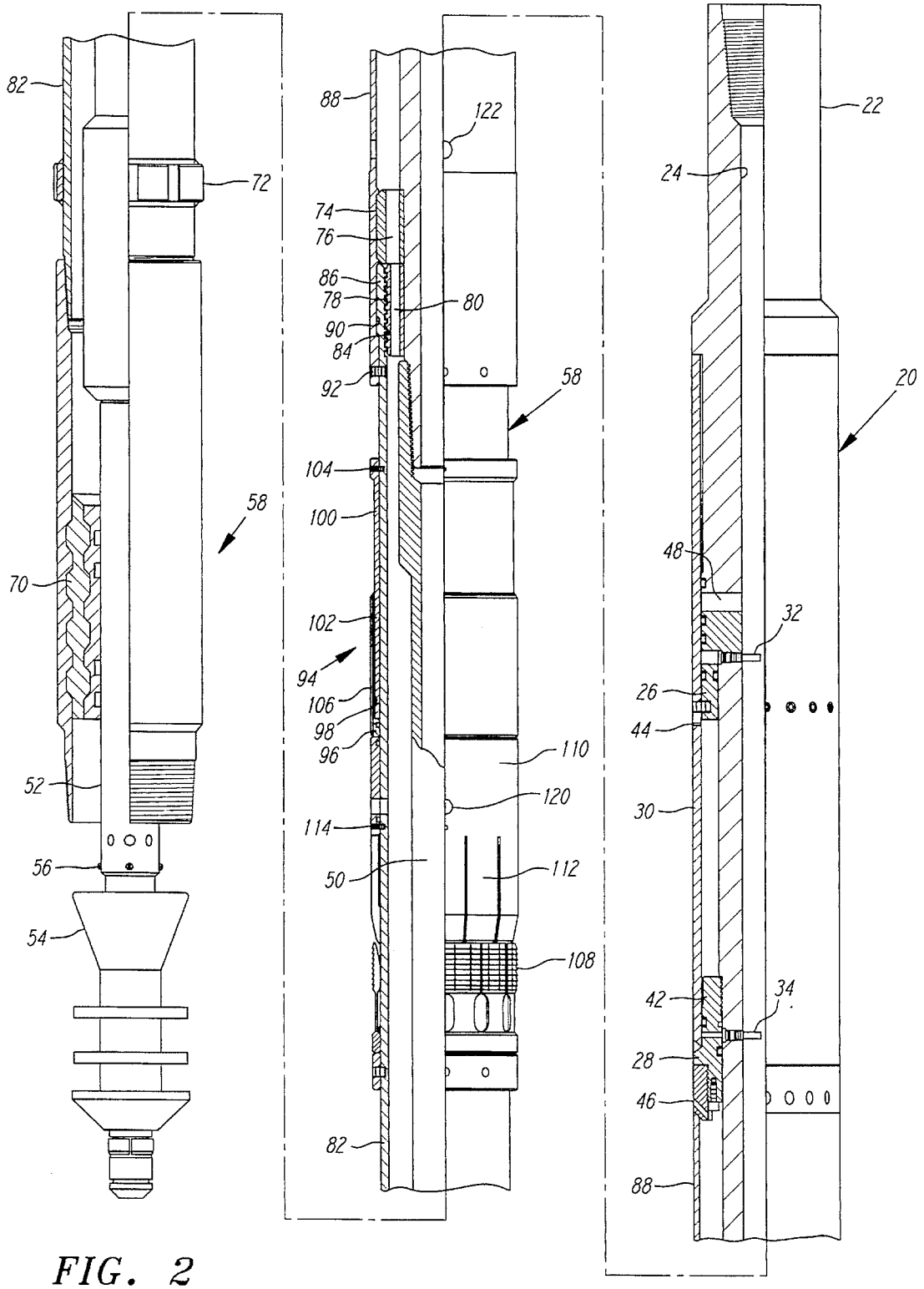
FIG. 2 is a portion of the string assembly of FIG. 1 partially illustrated in cross section.

Coupled to the sealed bumper 16 is a hydraulic setting tool 20. The hydraulic setting tool 20 is better illustrated in FIGS. 2 and 3. The hydraulic setting tool 20 illustrated in the preferred embodiment is a dual piston setting tool. A central tube 22 is threadably engaged at its upper end with the sealed bumper 16. A passageway 24 extends therethrough. Two annular pistons 26 and 28 operate in parallel around the central tube 22. An outer piston sleeve 30 is coupled with the annular pistons 26 and 28 such that the outer piston sleeve 30 may be driven downwardly when the cavities behind each of the pistons 26 and 28 are exposed to differential hydraulic pressure. Knockout plugs 32 and 34 are arranged such that when removed, communication is established between the central tube 22 and each of the pressure areas behind the annular pistons 26 and 28. A first annular pressure cylinder 36 is defined radially between the central tube 22 and the outer piston sleeve 30 and axially between a shoulder 38 on the central tube 22 and the upper surface of the annular piston 26. A second annular pressure cylinder 40 is radially defined in the same way and axially defined between the upper surface of the annular piston 28 and an annular seal 42. Relief ports 44 and 46 provide pressure relief ahead of each piston. Ports 48 extend radially through the wall of the central tube 22. The outer piston sleeve 30 covers over these ports 48 until the pistons are hydraulically actuated. Because of the upper skirt on the outer piston sleeve 30, the ports 48 are not opened to outwardly of the hydraulically setting tool 20 until the outer piston sleeve 30 has moved almost completely through its stroke.

The lower end of the central tube 22 is threadably engaged with a stinger 50. The stinger 50 is hollow, extending to a slick joint 52. A latch in liner wiper plug 54 is retained at the end of the slick joint 52 by a shear screw adapter 56. The latch in liner wiper plug 54 initially has a passageway therethrough for circulation of materials downwardly through the drill pipe 14, the sealed bumper 16, the central tube 22 and the stinger 50 with the slick joint 52.

A liner assembly, generally designated 58, is associated with the hydraulic setting tool 20, extending downwardly therefrom. The principal length of the liner assembly 58 is made up of liner sections 60 with collars 62. At the bottom of the liner assembly 58 is a drill bit 64. The drill bit 64 is threadably engaged with a drill-in shoe 66. The shoe 66 includes double flapper valves (not shown) for preventing circulation upwardly through the liner. Above the shoe 66 is a float collar 68 having a reduced ID for receiving and retaining the latch in liner wiper plug 54 when released by the shear screw adapter 56. Upwardly of the main body of liner sections 60 is a drillable seal bore 70. The stinger 50 with the slick joint 52 extends through the drillable seal bore 70 with the latch in liner wiper plug 54 located below that drillable seal bore 70. An OD fluted gage ring 72 is arranged to assist in centering of the liner assembly 58.

Between the hydraulic setting tool 20 and the drillable seal bore 70, the liner assembly 58 includes a coupling, a hanger system and a seal. The coupling includes external splines 74 fixed to the lower portion of the central tube 22. The external splines 74 extend fully about the central tube 22 and have circulation passages 76 therethrough. The splines 74 are shown in the preferred embodiment to be a separate element fixed in place by welding or the like. External threads 78 are also located about the central tube 22 below the splines 74. Again, circulation passages 80 extend through the external threads 78. The threads are part of a ring fixed by welding or similar technique to the outer periphery of the central tube 22. The threads are lefthand threads.

An uppermost liner section 82 is conventionally threaded at its lower end to the drillable seal bore 70. At its upper end, internal reverse threads 84 are provided for mating with the external threads 78 located on the central tube 22 of the hydraulic setting tool 20. Also at the upper end of the liner section 82, external splines 86 are arranged about the periphery. The splines 86 are preferably the same as the external splines 74 associated with the central tube 22. Conveniently, the external splines 86 and the internal reverse threads 84 extend to the upper end of the uppermost liner section 82.

The liner assembly further includes an adapter sleeve 88. The adapter sleeve 88 forms a part of the coupling and has internal splines 90. These splines 90 are located near the bottom of the adapter sleeve 88. With the hydraulic setting tool 20 and the uppermost liner section 82 joined by the reverse threads 78 and 84 with the external splines 74 and 86 aligned, the internal splines 90 can be positioned over the external splines to retain the central tube 22 and liner assembly 58 coupled without possibility of separation. The adapter sleeve 88 extends upwardly from the uppermost liner section 82 to be axially aligned with the outer piston sleeve 30. Sheer pins 92 retain the adapter sleeve 88 in position relative to the uppermost liner section 82. However, when the hydraulic setting tool 20 is actuated so as to drive the outer piston sleeve 30 downwardly, the sheer pins 92 are broken and the splines 90 disengage the external splines 74. After this occurrence, the drill string can be detached from the liner assembly by rotating in the righthand direction.

The adapter sleeve 88, once the pins 92 have been sheered, is slidable on the uppermost liner section 82. It is originally arranged in a first position prior to the actuation of the hydraulic setting tool 20. It moves downwardly toward a second and final position. In that movement, the splines of the coupling are first released.

With continued downward movement of the adapter sleeve 88 under the influence of the hydraulic setting tool 20 toward the second position, the adapter sleeve 88 encounters a sleeve seal 94. The sleeve seal includes a cylinder 96 having a deformable cylindrical portion 98. A sleeve piston 100 is aligned with the cylinder 96 with the deformable cylindrical portion 98 extending to slightly overlap the top of the sleeve piston 100. A pressure fluidizing solid 102 is positioned within a cavity defined within the cylinder 96 beneath the deformable portion 98 and extending to the leading edge of the sleeve piston 100. The sleeve piston 100 also has a sheer pin 104 to retain the sleeve seal 94 in place until it is to be activated. An outer cylindrical seal 106 is positioned over the deformable cylindrical portion 98. In the preferred embodiment, this seal 106 is rubber and bonded to the deformable cylindrical portion 98. It may also be a plastic material, malleable metal or the like as may be appropriate to make a seal with an outer casing.

Beneath the sleeve seal 94 is a hanger system using a slips set. A full circle slips 108 is arranged about the uppermost liner section 82. A wedge sleeve 110 having wedge shaped fingers 112 is arranged about the uppermost liner section 82. Sheer pins 114 retain the wedge sleeve 110 in position until actuated. The wedge sleeve 110 also abuts against the sleeve seal 94 such that actuation of the hydraulic setting tool 20 will set the slips set in achieving the second position of the adapter sleeve 88.

The preferred embodiment has particular applicability to offshore drilling where it is very important to prevent any leakage which is typically not the case for other wells. A well is typically drilled to a predetermined depth. A casing 116 is located in the well extending down to a casing shoe 118. The well is typically drilled further and logged. Once this is completed, a soft bentonite cement fills the lower portion of the casing shoe 118 to define a plug. The cement can be easily drilled out when setting the liner.

When the well is to be completed, the assembly described above is lowered into the well until reaching the bentonite cement. At this point, drilling is commenced to drill the plug out and run the liner to the bottom. The liner may extend any desired distance below the casing 116. The drill bit may be 2000 feet or more below the end of the casing at this point. The equipment was set up with the liner wiper plug 54 just below the drillable seal bore 70. Circulation for the drilling operation was through the drill pipe 14, the central tube 22, the stinger 50 and the wiper plug 54. Return circulation was upwardly outside of the liner and into the annular space around the casing 116. Flow may also circulate through the circulation ports 120 and through circulation passages 76 and 80 to then pass outwardly through circulation ports 122 and 46.

Figure 3:
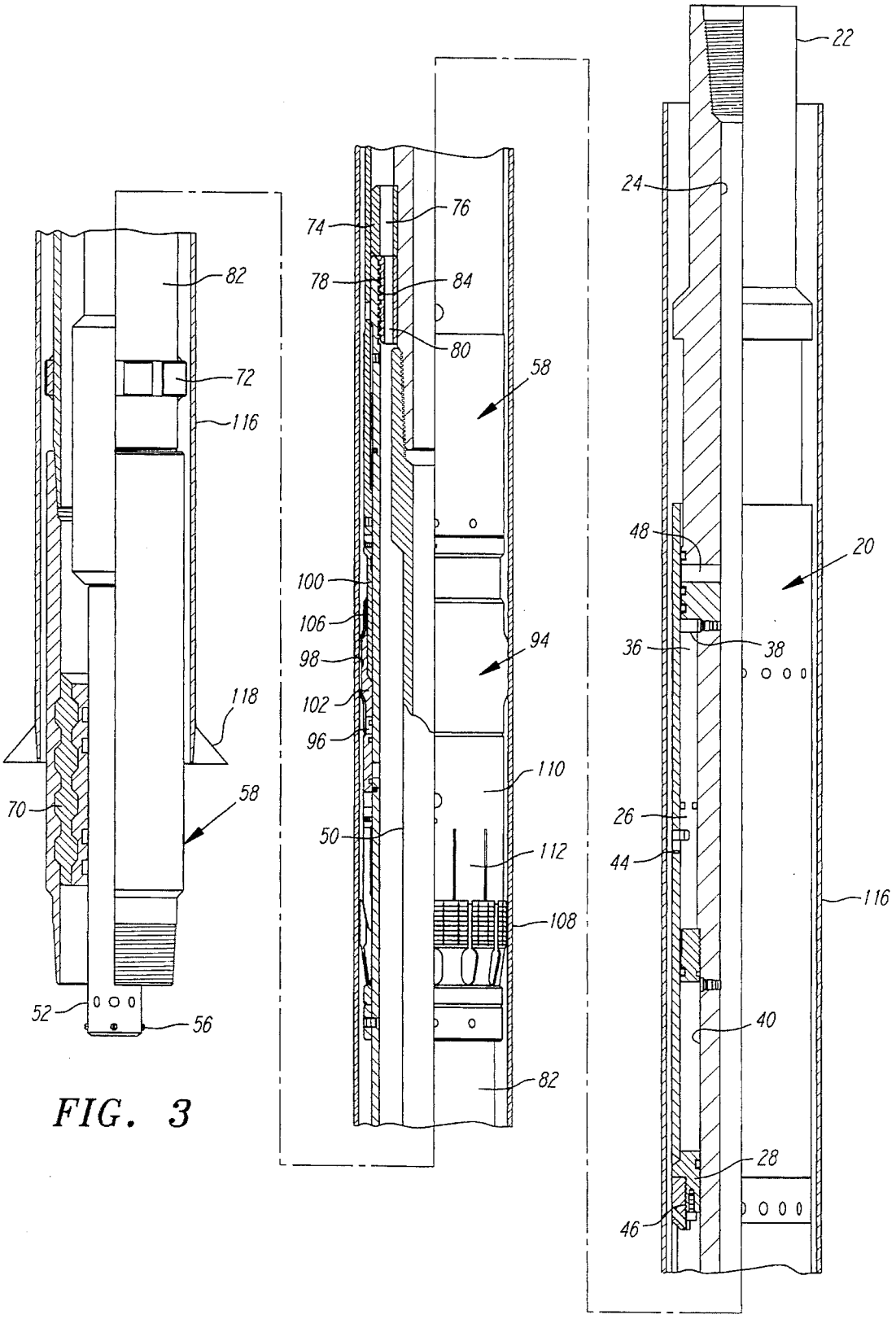
FIG. 3 is a portion of the string assembly of FIG. 2 with the piston setting tool advanced.
Figure 4:
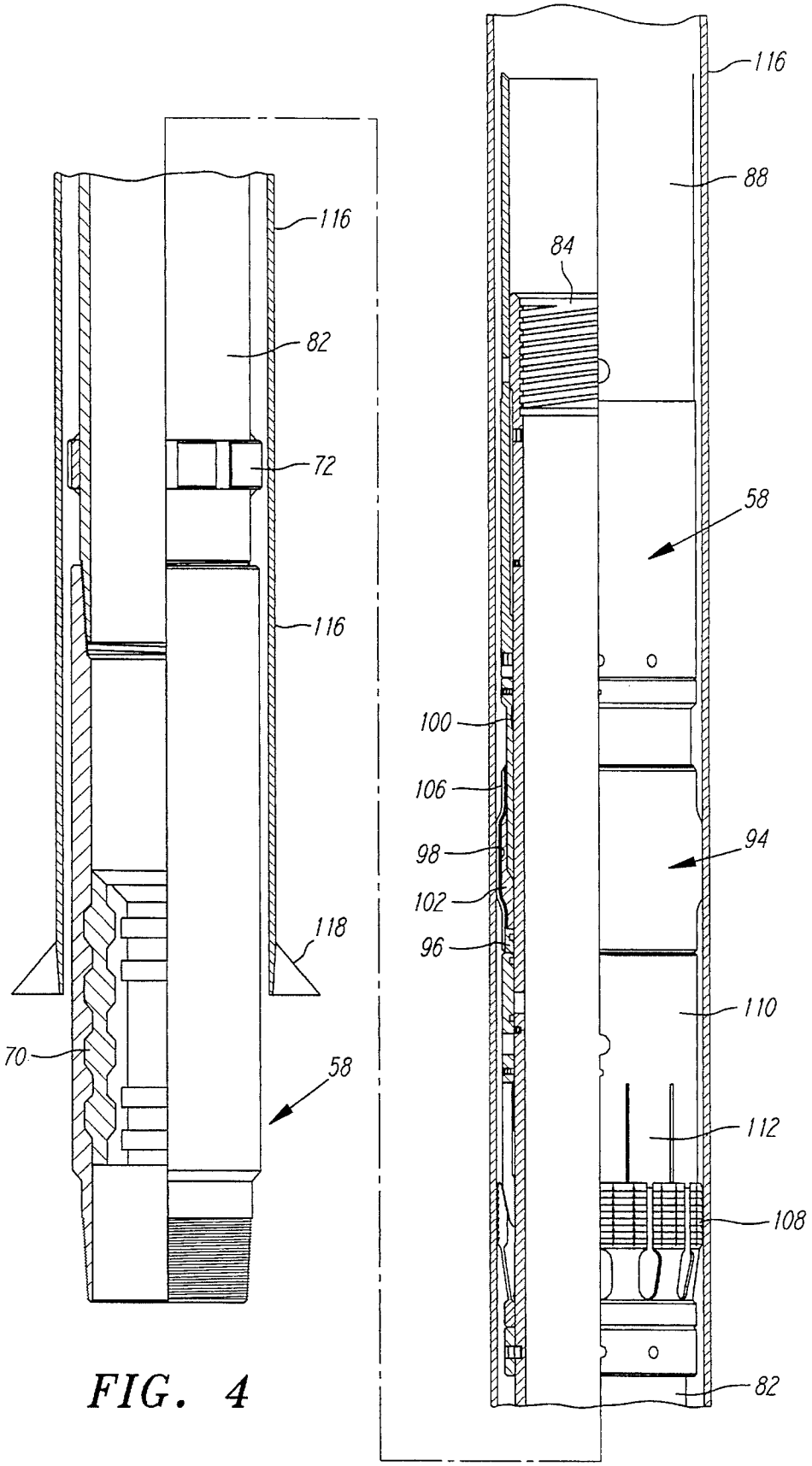
FIG. 4 is the completed liner assembly as illustrated in FIG. 3 with the piston setting tool removed.

Next, cement is introduced into the well. The cement passes down through the drill pipe 14 in the same manner as the drilling circulation. When the predetermined amount of cement has been introduced, the liner interior is voided of cement. This is accomplished by introducing the dart 18 into the top of the well and driving it downward with fluids. The dart passes without obstruction through to the latch in liner wiper plug 54 where it seats. As fluid pressure builds behind the latch in liner wiper plug 54, it parts from the shear screw adapter 56 and travels downwardly to the float collar 68 where it too seats. The float collar may be some 40 to 60 feet above the drill bit. The cement is pushed ahead of the wiper plug 54 and out of the liner. Thus, the liner is wiped clean of cement. In introducing the cement, a common practice is to either move the liner up and down to assist in the flow of the cement or to rotate or oscillate the liner, again to help cement flow. As the coupling is still engaged, these actions are permitted. In sending the dart 18 through the bore, the knockout plugs 32 and 34 are removed. Once the wiper plug 54 has reached the float collar 68, hydraulic pressure in the drill pipe and liner continues to build. This includes pressure in the annular pressure cylinders 36 and 40 to operate on the pistons 26 and 28. When a predetermined level of pressure is reached, the pins 92 are sheered and the adapter sleeve 88 can move downwardly from its first position. The splines 74 are disengaged to release the coupling. The pins 104 and 114 are then sheered to drive the wedge sleeve 110 into engagement with the full circle slips 108 to hang the liner assembly 58 in position. The sleeve seal 94 is also deformed to form a full seal with the casing. At this point, the adapter sleeve 88 has reached its second position under the influence of the hydraulic setting tool 20. This condition is illustrated in FIG. 3. The drill pipe is then rotated in a lefthand direction to release the central tube 22 from the uppermost liner section 82. The equipment is removed, leaving a cemented liner sealed to the casing and hung from the casing as illustrated in FIG. 4.

Thus, a mechanism for drilling in, placing, hanging, sealing and cementing a liner all in one process is provided. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A process for finishing a well having a casing, comprising placing a liner into a well including rotating a drill bit, a liner and a drill string into a desired position extending to below the casing;

introducing cement into the well bore;

voiding the liner interior of cement;

locking the top of the liner to the bottom of the casing;

removing the drill string after locking the top of the liner to the bottom of the casing.

2. A process for finishing a well having a casing, comprising:

placing a liner into a well including rotating a drill bit, a liner and a drill string into a desired position extending to below the casing;

introducing cement into the well bore;

voiding the liner interior of cement;

locking the top of the liner to the bottom of the casing after introducing cement into the well bore;

removing the drill string after locking the top of the liner to the bottom of the casing.

3. The process for finishing a well of claim 2 further comprising sealing the top of the liner to the bottom of the casing.

4. The process for finishing a well of claim 3, the introducing of cement preceding the locking of the top of the liner to the bottom of the casing and the sealing of the top of the liner to the bottom of the casing.

5. A process for finishing a well having a casing, comprising in seriatim:

placing a liner into a well including rotating a drill bit, a liner and a drill string into a desired position extending to below the casing;

introducing cement into the well bore;

voiding the liner interior of cement;

locking the top of the liner to the bottom of the casing:

sealing the top of the liner to the bottom of the casing;

removing the drill string after locking the top of the liner to the bottom of the casing.

* * * * *